US007935195B2

(12) United States Patent
Gaus

(10) Patent No.: US 7,935,195 B2
(45) Date of Patent: May 3, 2011

(54) MULTI-TANK DISHWASHER COMPRISING A BACKWASH DEVICE

(75) Inventor: Bruno Gaus, Offenburg (DE)

(73) Assignee: Meiko Maschinenbau GmbH & Co KG, Offenburg (DE)

( * ) Notice: Subject to any disclaimer, the term of this patent is extended or adjusted under 35 U.S.C. 154(b) by 644 days.

(21) Appl. No.: 11/846,519

(22) Filed: Aug. 28, 2007

(65) Prior Publication Data

US 2008/0041419 A1 Feb. 21, 2008

Related U.S. Application Data

(63) Continuation of application No. PCT/EP2006/000760, filed on Jan. 30, 2006.

(30) Foreign Application Priority Data

Feb. 28, 2005 (DE) ..... 10 2005 008 987

(51) Int. Cl.
*A47L 15/46* (2006.01)
*B08B 3/02* (2006.01)

(52) U.S. Cl. ..... 134/56 D; 134/103.1; 134/109; 134/111

(58) Field of Classification Search ..... 134/57 D, 134/56 D, 58 D, 103.1, 103.2, 104.2, 109, 134/111, 184, 186, 198, 200
See application file for complete search history.

(56) References Cited

U.S. PATENT DOCUMENTS

| | | | | |
|---|---|---|---|---|
| 4,952,014 | A | 8/1990 | Liebermann et al. | |
| 6,432,216 | B1 * | 8/2002 | Thies | 134/18 |
| 2002/0074026 | A1 | 6/2002 | Kim et al. | |

FOREIGN PATENT DOCUMENTS

| | | | |
|---|---|---|---|
| DE | 1428358 | | 11/1968 |
| DE | 2451822 | C2 | 5/1976 |
| DE | 3723721 | A1 | 5/1988 |
| DE | 69820625 | | 11/2004 |
| EP | 0378980 | A | 7/1990 |
| EP | 0702928 | * | 3/1996 |
| EP | 0702928 | A | 3/1996 |
| EP | 0976359 | * | 2/2000 |
| EP | 0976359 | A1 | 2/2000 |
| EP | 1256308 | A2 | 11/2002 |
| WO | WO-84/01498 | A | 4/1984 |

* cited by examiner

*Primary Examiner* — Michael Barr
*Assistant Examiner* — Saeed T Chaudhry
(74) *Attorney, Agent, or Firm* — Muncy, Geissler, Olds & Lowe, PLLC

(57) ABSTRACT

Multi-tank dishwashers are used, in particular, industrially, in order to clean items which are to be washed. The invention relates to a multi-tank dishwasher which is provided with a washing area. The washing area comprises at least one rinsing water storage tank, at least one filter housing, at least one fine filter and at least one backwash device. In the normal mode, a filter wall of the at least one fine filter is cross flown in the direction from a waste water chamber to a pure water chamber. In order to clean the fine filter, the multi-tank dishwasher can be operated in a backwashing mode, without interrupting the washing process. In said backwashing mode, a cross-flow of the at least one filter wall of the rinsing water is reversed by using a backwash pump and a waste water pump. Dirt particles, which are located on the inner side of the filter wall, are rinsed off and are removed by the waste water pump in the waste water outlet.

18 Claims, 4 Drawing Sheets

MULTI-TANK DISHWASHER COMPRISING A BACKWASH DEVICE

This nonprovisional application is a continuation of International Application No. PCT/EP2006/000760, which was filed on Jan. 30, 2006, and which claims priority to German Patent Application No. DE102005008987, which was filed in Germany on Feb. 28, 2005, and which are both herein incorporated by reference.

BACKGROUND OF THE INVENTION

1. Field of the Invention

The present invention relates to a multi-tank dishwasher with at least one washing zone for acting upon a wash batch with washing water in a washing chamber and comprising at least one washing water storage tank, at least one filter housing and a backwash device. The invention relates, furthermore, to a method for operating a multi-tank dishwasher, the method having normal operation and backwash operation.

2. Description of the Background Art

To clean wash batches, nowadays the commercial sector not only employs single-chamber automatic dishwashers, but also multi-tank dishwashers, in which the wash batch to be cleaned is transported by means of a conveying device through the various zones of the dishwasher. Multi-tank dishwashers of this type comprise, as a rule, at least one washing zone, at least one rinsing-clear zone and, optionally, a drying zone. In this case, the wash batch to be cleaned runs in succession through said treatment zones. For this run, multi-tank dishwashers may be designed, for example, as belt transport or basket transport machines. Both versions have in common the fact that the wash batch is transported, for example continuously, through the individual treatment zones by the transport means.

At the start of operation, in the multi-tank dishwasher, the washing water tanks of the washing zone are filled with fresh water and heated. Furthermore, cleaning agent is added to the washing water. In this case, a plurality of washing zones may be arranged one behind the other, the washing waters of which have, for example, different temperatures with different cleaning agents and/or with different cleaning agent concentrations.

A washing zone is normally designed as a chamber and typically has an inlet orifice and an outlet orifice. The wash batch is transported through these orifices and through the respective washing zone by means of the conveying device. Conventionally, a washing zone has a washing water tank and a circulating pump which sucks in washing water from the washing water tank and sprays it onto the wash batch via a spray system assigned to the washing zone. In this case, the dirt adhering to the wash batch is removed.

The washing water subsequently flows, together with the washed-off dirt, back into the washing water tank again. In this case, the washed-off dirt is filtered out of the washing water by means of a sieve system. Conventionally, sieve plates with hole diameters of 2 mm to 4 mm are used here, which cover the entire washing water tank. Dirt fractions which are smaller than the hole diameter are circulated together with the washing water.

Subsequently, in the multi-tank dishwasher, cleaning agent and dirt residues lying loosely on the wash batch are washed off by means of hot fresh water in one or more rinsing-clear zones. A rinsing-clear agent may in this case be added additionally to the hot fresh water. The fresh water or rinsing-clear water is then supplied usually completely or partially to a washing water tank of a washing zone, in order to dilute the dirt fractions located there in the washing water tank. After running through one or more rinsing-clear zones, the wash batch optionally runs through one or more drying zones in which the wash batch is dried.

The abovementioned sieve plates in the at least one washing zone often have the disadvantage that the dirt filtered out from the washing water remains lying on these and is not actively removed from the washing zone. By the washing water falling down, this dirt may be further comminuted and then likewise passes, with a time delay, into the washing water of the washing zone and increases the dirt content of the washing water there. This is a disadvantage particularly since the respective cleaning capacity of a washing zone typically decreases with the quantity of dirt in the washing water.

The dirt content of the washing water of the washing zone may be counteracted by increasing the fraction of rinsing-clear water supplied to the washing zone from the rinsing-clear zone. The disadvantage of this, however, is that, in this method, the consumption of cleaning agent which has to be added to the washing water rises in the same ratio. Operating costs and environmental pollution increase as a result.

A further possibility of reducing the dirt fraction in the washing water of the washing zone is to use sieve plates of smaller hole diameter in the washing zone. A smaller diameter of the sieve holes increases the risk, however, that the sieve plate becomes blocked. A partial or complete blockage of the sieve plate means, however, that sufficient washing water no longer flows back into the washing water storage tank, with the result that the pump pressure with which the wash batch is acted upon with washing water decreases and therefore the washing action is adversely influenced.

If a certain dirt content in the washing water is overshot in the washing zone in spite of the normally employed sieve plates and the supply of rinsing-clear water from the rinsing-clear zone, then, as a rule, the entire washing water tank contents have to be changed. This entails costs in terms of water and sewage. Furthermore, this means, as a rule, a stoppage time for the dishwasher, and also increased personnel costs for cleaning the respective washing zone and costs for heating energy to heat up the washing water to the preset temperature of usually 60° C., as well as costs for the new cleaning agent which has to be added to the washing water again.

From the sector of single-chamber dishwashers, filter systems are known in which the washing water storage tank is likewise covered by a sieve plate. In one region of the sieve plate, however, a coarse sieve is used, which is followed by a fine sieve. The washing water is likewise circulated within the "washing" program steps. Part of the washing water, after the latter has run through the coarse sieve, flows through the fine sieve. The fine dirt fractions of the washing water are also retained in the latter. When the washing water is changed, a sewage pump conveys the washing water, together with the fine and coarse dirt, out of the fine sieve into the sewage.

A device of this type is described in DE 24 51 822 C2. The device described in this publication discloses a collecting bowl for a dishwasher, with a first suction-intake space connected to a lye pump and with a second suction-intake space connected to a circulating pump. The first and the second suction-intake space are in this case connected to one another by means of a fine filter sieve. In a suction-extraction step, washing liquid is suction-extracted from the dishwasher, washing liquid being drawn off from both suction-intake spaces by means of the lye pump.

DE 14 28 358 illustrates a further design of a single-chamber dishwasher. This known embodiment additionally has spray nozzles which spray onto a fine filter from outside, with the result that the fine filter is cleaned and dirt residues can be removed by means of a sewage pump. A similar self-cleaning principle, in which a filter element is cleaned by means of a spray nozzle, is also disclosed in EP 0 976 359 A1 and DE 69 820 625 T2. EP 1 256 308 A2 discloses a device which, in addition to a spray nozzle, also additionally has a dirt comminutor.

The devices known from the prior art typically function to the effect that the washing operation is interrupted for cleaning the fine sieve. In this case, a separate program step of fine sieve cleaning is carried out, with the washing water pump switched off. This is due, in particular, to the fact that in the devices described, in washing operation a washing liquid constantly flows through the fine sieve in a filter direction, so that the fine sieve is not directly accessible for cleaning (for example spraying from outside). This interruption in the washing operation for cleaning the sieves used thus entails an additional amount of time, during which the respective washing chamber cannot be employed.

The described embodiments known from the prior art therefore have in common the fact that they are designed for use in single-tank water-changing machines and cannot readily be transferred to a continuously operating washing zone of a multi-tank dishwasher. In a multi-tank dishwasher, a washing water circulating pump operates permanently, relatively large washing water quantities per minute being circulated, and therefore relatively large quantities of washing water flowing constantly into the fine filter. In operation of this type, a cleaning of the sieves used, for example by spraying, particularly in a separate cleaning step, can be implemented only with difficulty in technical terms and, particularly in the case of industrial applications, would cause a troublesome and costly interruption in washing operation.

SUMMARY OF THE INVENTION

It is therefore an object of the present invention to provide a dishwasher, in particular a multi-tank dishwasher, which avoids the abovementioned disadvantages of the prior art. In particular, in this case, a simple filter system for circulating washing water of a washing zone is to be used.

A feature of the present invention is that a backwash device is used, which reverses a washing water flow through a fine filter, without the washing operation of the dishwasher having to be interrupted. For this purpose, a multi-tank dishwasher is proposed which can have at least one washing zone for acting upon a wash batch with washing water in a washing chamber. Furthermore, the washing zone has a washing water storage tank, at least one filter housing, at least one fine filter introduced into the at least one filter housing and at least one backwash device. The at least one fine filter subdivides at least one inner space of the at least one filter housing into at least one dirty water space and at least one clean water space. In this case, the at least one dirty water space is capable of being acted upon with washing water from the washing chamber via at least one washing water inflow. This at least one washing water inflow may have, in particular, at least one coarse sieve. Furthermore, the at least one fine filter has at least one filter wall having, for example, perforated plate or wire fabric. In a normal operation of the multi-tank dishwasher, washing water flows from the at least one dirty water space through the at least one filter wall into the at least one clean water space. This at least one clean water space is connected to the at least one washing water storage tank via at least one outflow device, advantageously an outflow orifice or an outflow connection piece.

The at least one backwash device can have at least one washing water return connected to the at least one clean water space. This washing water return may, for example, connect the at least one washing water storage tank to the at least one clean water space and has at least one backwash pump. Furthermore, the backwash device has a sewage line connected to the at least one dirty water space and having at least one sewage pump.

The backwash device can be designed in such a way that, in backwash operation, a washing water flow between the at least one clean water space and the at least one dirty water space through the at least one filter wall is reversible. This may take place, in particular, in that, in backwash operation, a washing water pressure ratio between the at least one clean water space and the at least one dirty water space can be reversed.

The at least one washing water return may be connected, for example, to the at least one outflow device. In particular, a flow direction of the washing water out of the at least one clean water space into the at least one washing water storage tank can define an outflow direction in normal operation. Advantageously, the connection between the washing water return and outflow device is then designed in such a way that, in backwash operation, the at least one outflow device is acted upon by means of the at least one washing water return by washing water which has a velocity component opposite to this outflow direction.

In particular, this may take place in that the washing water return has a backwash connection piece which issues in the outflow device, for example the outflow connection piece, the backwash connection piece issuing into the at least one outflow device, for example, at an angle less than or equal to 90° (advantageously, less than 70° and preferably less than 60°). Furthermore, the backwash connection piece may also be completely or partially identical to the outflow connection piece, so that two separate connection pieces do not have to be employed.

Thus, by means of the at least one backwash pump, the washing water flow in the at least one outflow device can be reversed, so that, overall, the washing water flow is reversed and the at least one fine filter is acted upon by a washing water flow conversely to normal operation. As a result, dirt which has accumulated on the at least one filter wall in the dirty water space is released from the at least one filter wall and can be removed via the at least one sewage line.

Advantageously, in backwash operation, the backwash pump and the sewage pump are simultaneously put into operation, in order simultaneously to lower the washing water pressure in the at least one dirty water space and to increase the washing water pressure in the at least one clean water space. In particular, for this purpose, the at least one sewage pump and the at least one backwash pump may be driven jointly by an individual pump motor.

Particularly in the development of the invention in which a backwash connection piece and an outflow connection piece are completely or partially identical, but also in other configurations of the invention, it may be advantageous if the at least one backwash pump can be designed as an axial pump which is integrated in the backwash connection piece or the backwash line. For the application described, axial pumps have, in particular, the advantage that a high volume flow is generated at a comparatively low pressure. This prevents, in particular, the situation where, during backwashing, too high a pressure builds up in the at least one clean water space which could damage the at least one fine filter or could press it out of the at least one filter housing.

The above-presented disclosure of the invention refers to a multi-tank dishwasher. However, the method and the principle according to the invention can also advantageously be applied to single-chamber systems.

The multi-tank dishwasher according to the invention overcomes the above-described disadvantages of the prior art in the most highly advantageous way. Thus, by means of the device described, the filter action of the at least one fine filter can be improved considerably. As a result, in particular, a quantity of water which has to be supplied into the at least one washing zone for dilution (for example, fresh water and/or rinsing-clear water supplied from at least one rinsing-clear zone) can be reduced considerably. Heating costs and costs for cleaning agent to be added can thereby be saved. Furthermore, the stoppage times of the machine and the personnel costs for cleaning the at least one washing zone are reduced. Backwash operation may be carried out simultaneously with washing operation, so that washing operation and therefore the cleaning of the wash batch are not influenced by the backwashing of the at least one fine filter. Washing operation therefore takes place irrespective of whether the at least one fine filter is in normal operation with the washing agent flow direction from the dirty water space to the clean water space or in backwash operation with the washing water flow in the opposite direction.

In order to change over between normal operation and backwash operation, it is advantageous, in particular, to monitor a degree of contamination within the at least one filter housing. In particular, in this case, the degree of contamination within the at least one dirty water space can be monitored, while a changeover can be made from normal operation to backwash operation, for example, when a predetermined degree of contamination is overshot. For this purpose, it is advantageous if the multi-tank dishwasher has at least one contamination sensor in the inner space of the at least one filter housing. For example, in the detection of contamination, use may be made of the fact that, with increasing contamination of the at least one filter wall, a washing water pressure and/or a washing water filling level within the at least one filter housing typically changers. For example, typically, the washing water level and/or the washing water pressure within the at least one dirty water space rise/s with an increasing contamination of the at least one filter wall. This rise can be monitored by means of corresponding sensors, for example commercially available pressure and/or filling level sensors.

In particular, the multi-tank dishwasher may have at least one electronic control device for changing over between normal operation and backwash operation, for example the at least one electronic control device activating the at least one backwash pump and the at least one sewage pump. Additional valves or the like may also be activated by the at least one electronic control device. In particular, the electronic control device may be an integral part of a comprehensive electronic control device of the multi-tank dishwasher. For example, the electronic control device may be connected to the at least one contamination sensor, and, as soon as it is detected that a predetermined degree of contamination is overshot, there can be automatic changeover between normal operation and backwash operation.

Furthermore, the multi-tank dishwasher may have at least one tank cover sieve, washing water being capable of passing out of the washing chamber through the at least one tank cover sieve into the at least one washing water storage tank. In particular, this tank cover sieve may be an integral part of a washing water storage tank cover.

The at least one fine filter may be equipped as an exchangeable filter insert with a sewage connection piece. In particular, it is advantageous if the filter insert is sealed off, leak tight, with respect to the filter housing so that, during backwashing, washing water can pass only through the at least one filter wall from the clean water space into the dirty water space, but not the other way. An optimal pressure difference between the dirty water space and clean water space can thereby build up, so that a high backwash with an optimal cleaning action through the at least one filter wall occurs.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
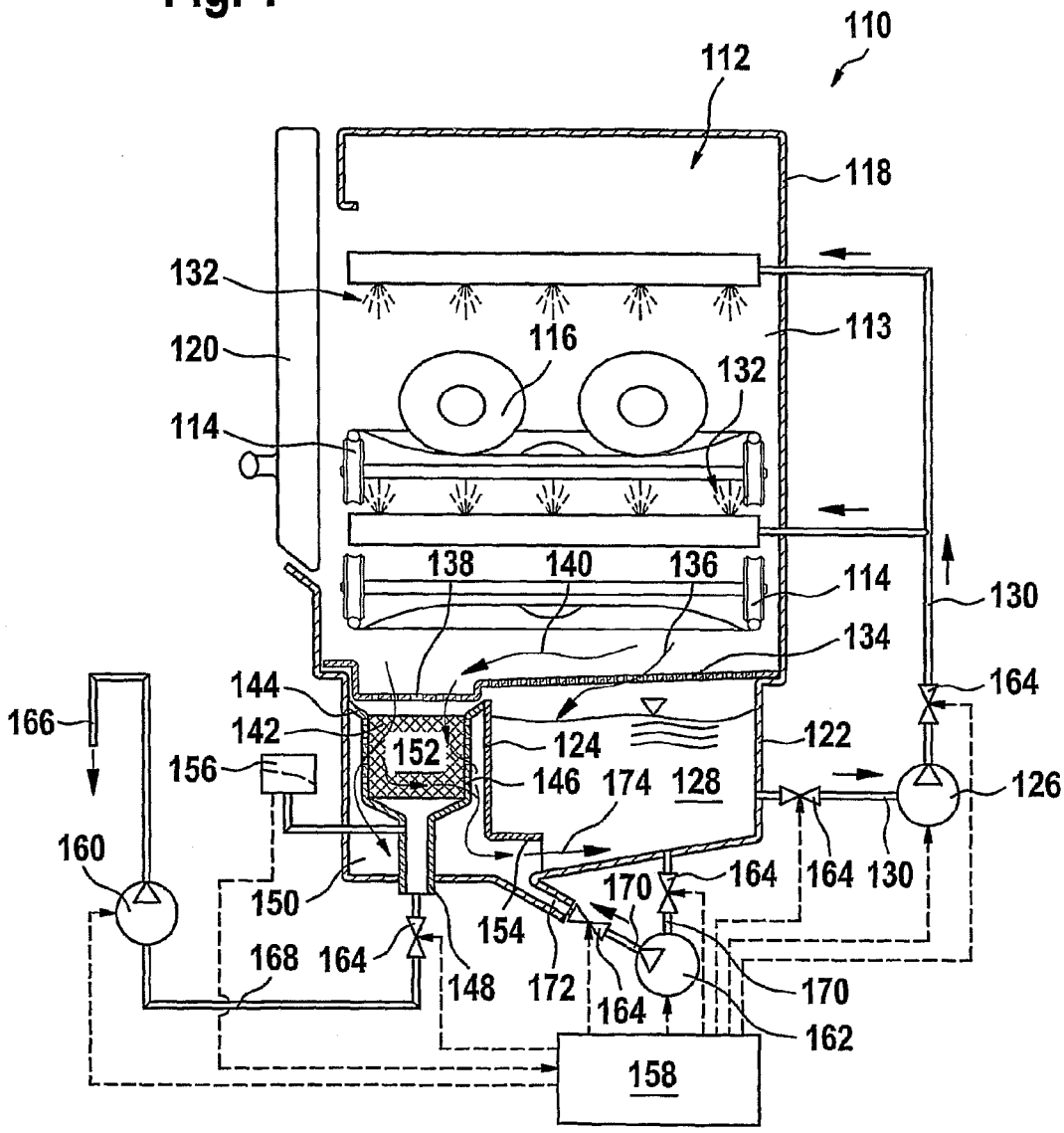
FIG. 1 shows a section through a washing zone of a multi-tank dishwasher according to the invention perpendicularly to a conveying direction.

FIG. 1 illustrates diagrammatically a multichamber dishwasher 110, FIG. 1 showing a section through a washing zone 112 of the multichamber dishwasher 110 in a sectional plane perpendicular to a conveying direction of a transport device 114. Various types of transport devices 114 may be envisaged, for example transport devices 114 for belt transport or for basket transport. The multichamber dishwasher 110, in this exemplary embodiment, is designed as a belt transport machine in which a wash batch 116 is transported through the multichamber dishwasher 110 on the transport device 114 designed as a conveyor belt.

The multichamber dishwasher 110 has a washing chamber 113 with a housing 118 which can opened laterally by means of an access door 120. A washing water storage tank 122 and a filter housing 124 are introduced in the bottom of the housing 118. A washing water circulating pump 126 sucks in washing water 128 via a circulation pipeline system 130 from the washing water storage tank 122 and conveys it via the circulation pipeline system 130 to washing nozzles 132. The washing water 128 is sprayed over the wash batch 116 there, with the result that the wash batch 116 is cleaned. The washing water 128, together with dirt which has been released from the wash batch 116, subsequently drops to the bottom of the housing 118. This bottom has, above the washing water storage tank 122, a tank cover sieve 134 which is pierced for the most part with sieve holes. Sieve holes with a diameter of approximately 1 mm to 4 mm, preferably 1.5 mm to 2.5 mm, particularly preferably 2.0 mm are preferably used in this case. Part of the washing water 128 flows through these holes directly to the washing water storage tank 122 (illustrated symbolically in FIG. 1 by the arrow 136). An (optional) supply of fresh water and/or rinsing-clear water from a rinsing-clear zone into the washing water storage tank 122 is not illustrated in FIG. 1.

The tank cover sieve 134 has a descending gradient in the direction of a coarse sieve 138. This coarse sieve 138 is inserted into the filter housing 124. A second part of the washing water 128 (indicated symbolically in FIG. 1 by the arrow 140) therefore flows via the coarse sieve 138 into the filter housing 124.

Inside the filter housing 124 is mounted a fine filter 142. This fine filter 142, in this exemplary embodiment, is designed as a filter insert 142 which has a sealing extension 144, a filter wall 146 and a sewage connection piece 148 and which can be inserted into the filter housing 124 from above. According to the invention, instead of a fine filter 142, a fine sieve, preferably with sieve holes having a diameter of less than 1.5 mm, particularly preferably of less than 1.0 mm, can also be employed.

The fine filter 142 therefore subdivides the inner space of the filter housing 124 into a clean water space 150 and a dirty water space 152. The sealing extension 144 prevents the situation where washing water 128, during backwashing, may pass directly from the clean water space 150 into the dirty water space 152, so that the washing water 128 has to penetrate through the filter wall 146 during backwashing. For this purpose, the sealing extension 144 seals off the fine filter 142 with respect to the filter housing 124. Furthermore, the sealing extension 144 is configured as a funnel extension which prevents the situation where washing water 128 can pass through the coarse sieve 138 directly into the clean water space 150.

In the fine filter 142, the washing water 128 flows through the filter wall 146 from the dirty water space 152 into the clean water space 150 (normal operation). In this case, fine dirt particles are filtered out on the inside of the filter wall 146. The filtered washing water 128 subsequently flows out of the clean water space 150 through an outflow connection piece 154 in the lower region of the filter housing 124 to the washing water storage tank 122 again.

Depending on the quantity of dirt particles filtered out on the inside of the filter wall 146, the through flow capacity of the washing water 128 through the fine filter 142 decreases with time. As a result of this, the level of the washing water 128 in the dirty water space 152 rises with time. This rise can be detected by suitable sensors. Thus, in the exemplary embodiment according to FIG. 1, for example, a pressure sensor 156 is used which detects the washing water pressure in the fine filter 142. Alternatively, the pressure sensor 156 may also be arranged, for example, in a sewage line 168 (upstream of a valve 164). An output signal from this pressure sensor 156 is fed to an electronic control unit 158. This electronic control unit 158 can (optionally) initiate a backwashing operation by a corresponding control of a sewage pump 160, a backwash pump 162 and various valves 164, for example when a certain pressure level or a certain dirt content in the dirty water space 152 is reached.

In normal operation, therefore, washing water 128 flows through the filter wall 146 in the direction from the dirty water space 152 to the clean water space 150. For the backwashing and self-cleaning of the fine filter 142, the flow direction of the washing water 128 through the filter wall 146 is reversed. For this purpose, the sewage pump 160 sucks away washing water 128 from the dirty water space 152 of the fine filter 142 via the sewage connection piece 148 and conveys it via a sewage line 168 into a sewage outflow 166. At the same time, by means of the backwash pump 162, washing water 128 is sucked out of the washing water storage tank 122 via a backwash line 170 and pumped via a backwash connection piece 172 into the outflow connection piece 154 in such a way that the through flow of the washing water 128 through the outflow connection piece 154 is disturbed. In this advantageous exemplary embodiment, the backwash connection piece 172 is arranged at an angle of approximately 40° to the outflow connection piece 154. Consequently, during backwashing, the washing liquid 128 which is pumped through the backwash connection piece 172 into the outflow connection piece 154 has a flow direction opposite the flow direction of the washing water 128 in normal operation (identified symbolically in FIG. 1 by the arrow 174).

As a result of the so disturbed outflow of the washing liquid 128 through the outflow connection piece 154 in backwash operation and of the washing liquid 128 supplied to the clean water space 150 via the backwash connection piece 172, the pressure of the washing liquid in the filter housing 124, in particular in the clean water space 150, rises, while at the same time the pressure in the dirty water space 152 falls as a result of pumping away by the sewage pump 160. The flow direction of the flow through the filter wall 146 is thereby reversed in backwash operation in spite of the running washing water circulating pump 126 and the associated inflow of washing water 128 into the fine filter 142. Owing to this reversed flow, dirt particles adhering to the inside of the filter wall 146 are released and can be pumped into the sewage outflow 166 by means of the sewage pump 160.

In this exemplary embodiment, the sewage pump 160 and the backwash pump 162 may be operated, for example, by means of a common pump motor (not illustrated in FIG. 1). This is due particularly to the fact that, in backwash operation, the sewage pump 160 and the backwash pump 162 are required simultaneously and are operated simultaneously. Overall operation, that is to say, in particular, the changeover from normal operation to backwash operation, can be controlled by means of the electronic control unit 158 which, for example, may be an integral part of a comprehensive control unit for the overall multi-tank dishwasher 110. In particular, a washing operation of the multi-tank dishwasher 110 does not have to be interrupted for backwashing.

Figure 2:
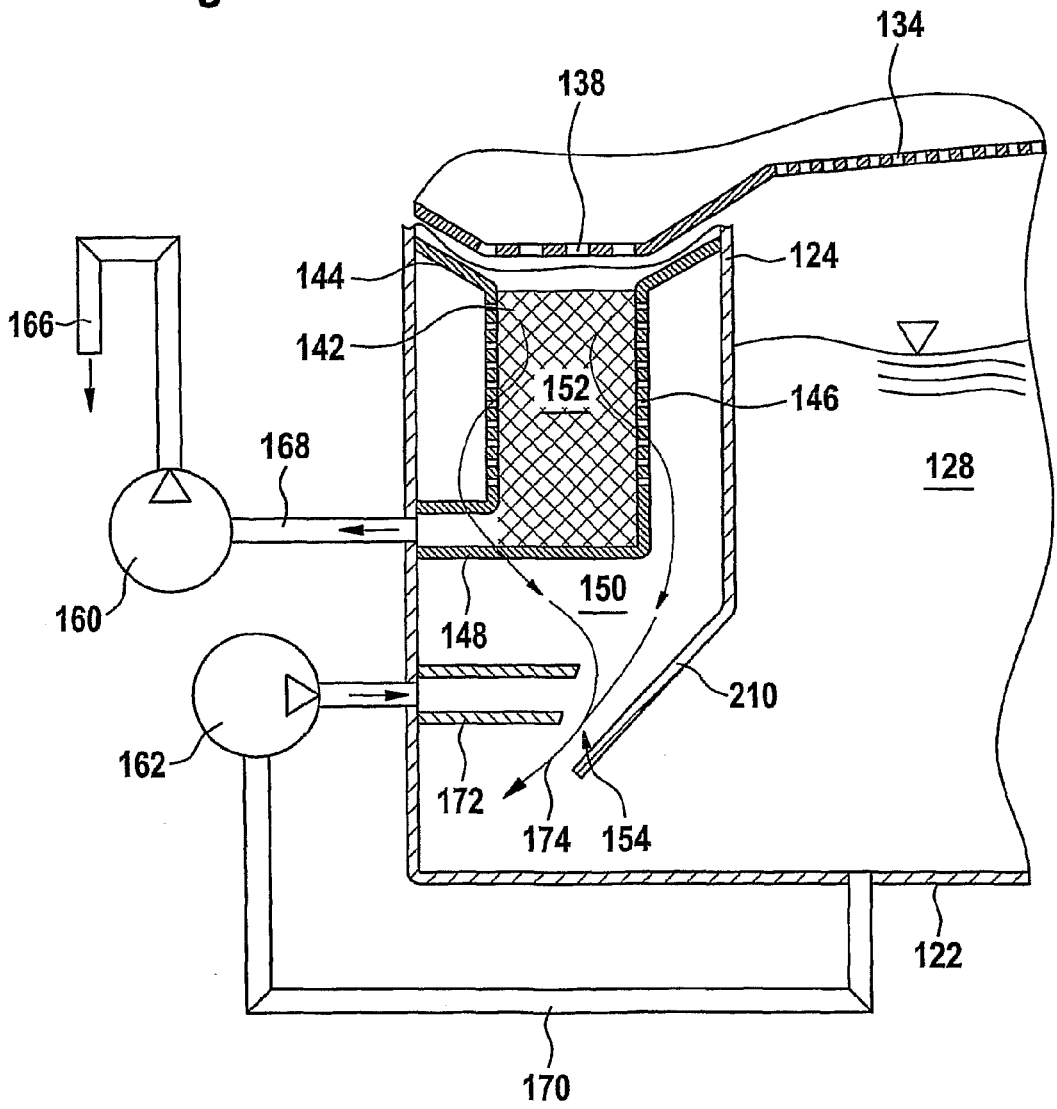
FIG. 2 shows a detail of a preferred embodiment, alternative to the embodiment according to FIG. 1, of a multi-tank dishwasher with a washing water storage tank having a filter housing.

FIG. 2 illustrates a detail of an embodiment, alternative to the version according to FIG. 1, of a washing water storage tank 122. In this exemplary embodiment, the sewage connection piece 154 bent at right angles and the backwash connection piece 172 are arranged on the left outer wall, pointing away from the washing water stock 128, of the filter housing 124. In this exemplary embodiment, the outflow device 154 is not designed as a tubular extension, as in the exemplary embodiment according to FIG. 1, but has essentially a simple orifice to the washing water storage tank 122. Furthermore, in this exemplary embodiment, the backwash device has a baffle surface 210 as a deflection device which extends downward beyond the lower edge of the backwash connection piece 172. This deflection device 210 has the effect that, in normal operation, washing water 128 emerges from the filter housing 124 at an angle to the vertical in a flow direction 174. When washing water 128 is pumped through the backwash connection piece 172 into the clean water space 150 in backwash operation, this deflection device has the effect that the washing water 128 pumped through the backwash connection piece 172 impinges at an angle of <90° onto the washing water 128 emerging from the clean water space 150 through the outflow device 154. The backwashed washing water 128 therefore has a velocity component opposite to the flow direction in normal operation 174 and therefore disturbs the outflow of the washing water 128 through the outflow device 154. Thus, in backwash operation, a higher pressure can build up in the clean water space 150 than in the dirty water space 152, with the backwash pump 162 running and with the sewage pump 160 running, so that the filter wall 146 is backwashed optimally.

Furthermore, it can be seen in FIG. 2 how the funnel-shaped sealing extension 144 seals off the fine filter 142 with respect to the filter housing 124, so that the greatest possible pressure difference can build up in backwash operation between the clean water space 150 and dirty water space 152.

Figure 3:
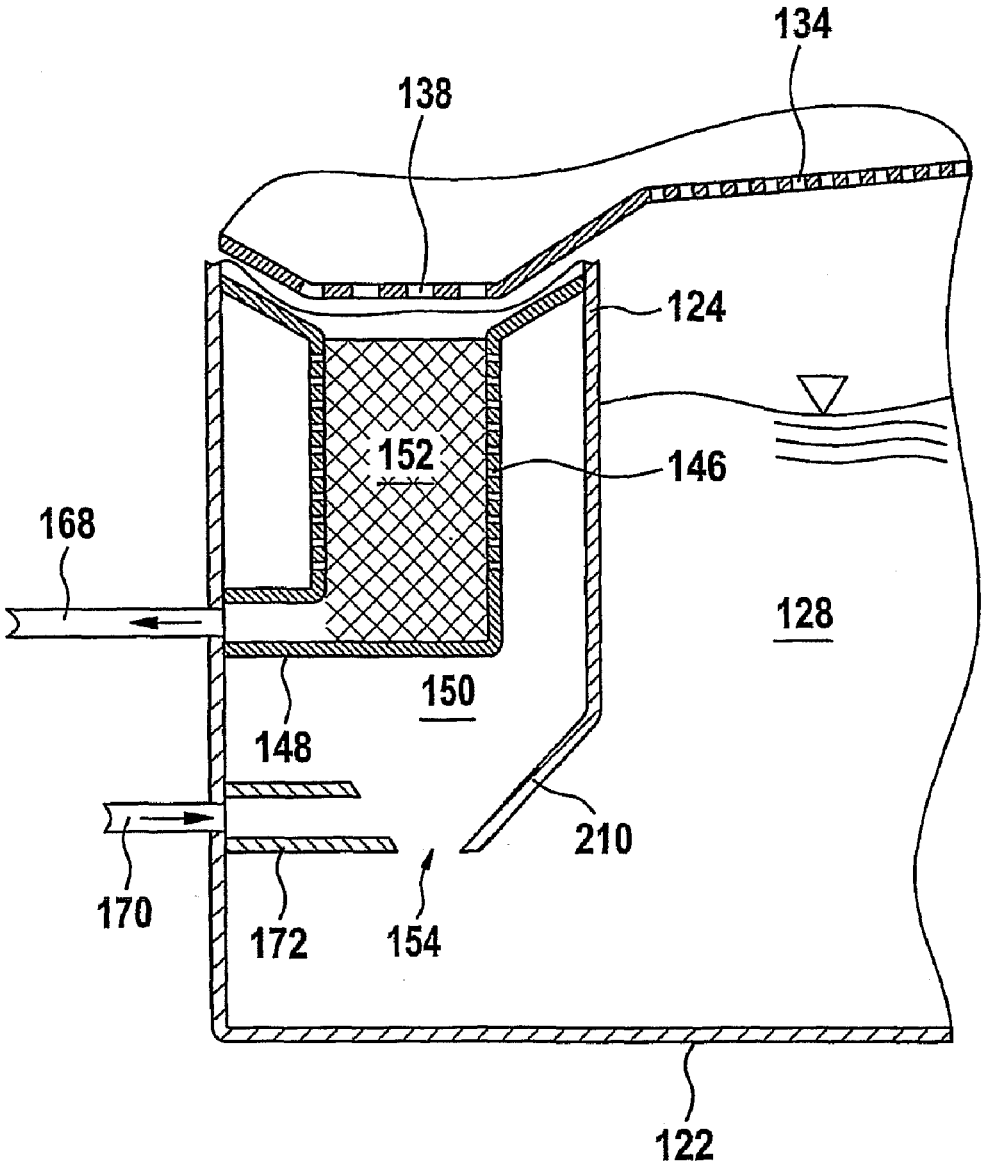
FIG. 3 shows a simpler embodiment, alternative to FIG. 2, of a washing water storage tank of a multi-tank dishwasher.

FIG. 3 illustrates an exemplary embodiment which is modified slightly, as compared with the version according to FIG. 2. The essential difference in this version is that the outflow device 154 is designed here as a simple orifice in the bottom of the filter housing 124. The baffle surface 210 in this case does not extend beyond the bottom of the filter housing 124. This version is therefore simpler than the version in FIG. 2, but does not have the same backwash action, since the above-described "disturbing effect" of the outflow of the washing water 128 from the clean water space 150 into the washing water storage tank 122 due to action by washing water 128 with an opposite velocity component through the backwash connection piece 172 does not occur to the same extent as in FIG. 2. However, in this exemplary embodiment too, there is a backwash effect according to the invention.

Figure 4:
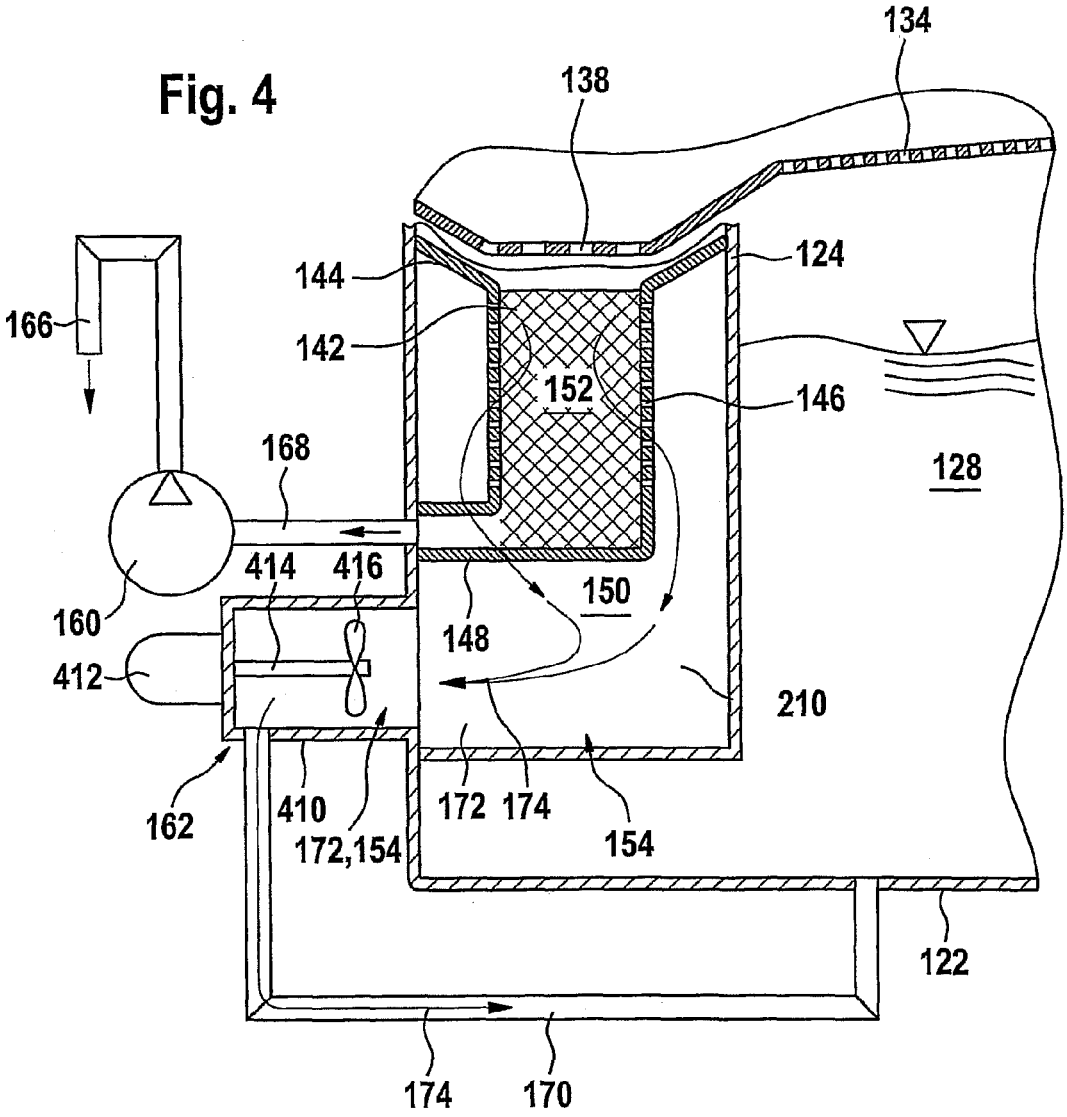
FIG. 4 shows an embodiment, alternative to FIGS. 2 and 3, with an identical washing water return and outflow connection piece.

FIG. 4 illustrates a particularly preferred embodiment of the invention which is alternative to FIGS. 2 and 3 and in which backwashing takes place via the same connection pieces 154, 172 as the outflow of washing water 128 out of the clean water space 150 into the washing water storage tank 122. In normal operation, the outflow of washing water 128 from the clean water space 150 into the washing water storage tank 122 takes place in the flow direction 174 through the backwash line 170. During backwashing, washing water 128 is pumped out of the washing water tank 122 through the same backwash line 170 into the clean water space 150, the backwashed washing water 128 having an exactly reversed velocity, as compared with the flow direction 174 in normal operation.

In this exemplary embodiment, the baffle surface 210 has been dispensed with, although such a baffle surface 210 may be used additionally. The filter housing 124 is opened outward to a pumping connection piece 410 which extends at right angles to the filter housing 124 and which is widened in cross section, as compared with the backwash line 170 which again branches off at right angles from the pumping connection piece 410. For example, a pumping connection piece having a cross section of 80 mm may be used.

Admittedly, basically different types of pumps, for example centrifugal pumps, etc., may be used as the backwash pump 162. In the exemplary embodiment according to FIG. 4, however, an axial pump 162 is used as a backwash pump 162. A pump motor 412 is placed onto the pumping connection piece 410 on the outside and drives a pump shaft 414, with a rotor 416 placed on it, in the pumping connection piece 410. For example, a rotor 416 may be used which still leaves free an orifice of approximately 70% of the pumping connection piece 410. Thus, in normal operation, in which washing water 128 flows in the flow direction 174 through the pumping connection piece 410, with the backwash pump 162 switched off, a low flow resistance for the outflowing washing water 128 is ensured. By contrast, in backwash operation, in this exemplary embodiment the axial pump 162 ensures a high volume flow of the backwashed washing water 128, without too high a pressure being built up in the clean water space 150 which could damage the fine filter 142 or press it out of the filter housing 124. In particular, it is advantageous if a backwash pump 162 is used which, during backwashing, causes between the suction side and the pumping side a pressure rise of no more than 0.5 bar, preferably of no more than 0.2 bar and particularly preferably of no more than 0.1 bar.

The exemplary embodiment illustrated in FIG. 4 can be implemented in a technically simple way and makes it possible, for the reasons mentioned, to have a particularly efficient and fault-free backwash operation of the multichamber dishwasher 110.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A multi-tank dishwasher with at least one washing zone for acting upon a wash batch with washing water in a washing chamber, the at least one washing zone comprising:

at least one washing water storage tank;

at least one filter housing;

at least one fine filter introduced into the at least one filter housing, the at least one fine filter subdividing at least one inner space of the at least one filter housing into at least one dirty water space and at least one clean water space, the at least one dirty water space being capable of being acted upon with washing water from the washing chamber via at least one washing water inflow, the at least one fine filter having at least one filter wall, in such a way that, in a normal operation of the multi-tank dishwasher, washing water flows from the at least one dirty water space through the at least one filter wall into the at least one clean water space, and the at least one clean water space being connected to the at least one washing water storage tank via at least one outflow device whereby clean water flows from said at least one clean water space to said at least one washing water storage tank; and at least one backwash device comprising:

at least one washing water return connected to the at least one clean water space;

at least one backwash pump;

at least one sewage line connected to the at least one dirty water space; and at least one sewage pump, wherein, in a backwash operation, a washing water flow between the at least one clean water space and the at least one dirty water space through the at least one filter wall is reversible via the backwash device.

2. The multi-tank dishwasher as claimed in claim 1, wherein the at least one outflow device has at least one outflow connection piece and/or at least one outflow orifice.

3. The multi-tank dishwasher as claimed in claim 1, wherein the at least one washing water return is connected to the at least one outflow device.

4. The multi-tank dishwasher as claimed in claim 1, wherein the at least one washing water return has a backwash connection piece, and wherein the at least one outflow device has an outflow connection piece, the outflow connection piece and the backwash connection piece being formed completely or partially by the same component.

5. The multi-tank dishwasher as claimed in claim 1, wherein the at least one backwash pump has at least one axial pump.

6. The multi-tank dishwasher as claimed in claim 1, wherein the inner space of the at least one filter housing has at least one contamination sensor.

7. The multi-tank dishwasher as claimed in claim 6, wherein the at least one contamination sensor has at least one pressure sensor and/or at least one filling level sensor for measuring a pressure and/or a filling level in the at least one dirty water space and/or the at least one clean water space.

8. The multi-tank dishwasher as claimed in claim 1, wherein the at least one washing water storage tank has at least one tank cover sieve, washing water being capable of passing out of the washing chamber through the at least one tank cover sieve into the at least one washing water storage tank.

9. The multi-tank dishwasher as claimed in claim 1, the at least one washing water inflow having at least one coarse sieve.

10. The multi-tank dishwasher as claimed in claim 1, wherein the at least one fine filter seals off the at least one inner space of the at least one filter housing in such a way that a direct penetration of washing water from the at least one clean water space into the at least one dirty water space is prevented in backwash operation.

11. The multi-tank dishwasher as claimed in claim 1, having at least one electronic control device for changing over between normal operation and backwash operation, in backwash operation the at least one backwash pump and the at least one sewage pump being activatable by means of the at least one electronic control device.

12. The multi-tank dishwasher as claimed in claim 11, wherein the control device is adapted in that the changeover between normal operation and backwash operation takes place automatically as a function of a degree of contamination.

13. The multi-tank dishwasher as claimed in claim 1, wherein the at least one fine filter is designed as an exchangeable filter insert with a sewage connection piece.

14. The multi-tank dishwasher as claimed in claim 1, wherein the at least one sewage pump and the at least one backwash pump are driven jointly by a pump motor.

15. The multi-tank dishwasher according to claim 1, wherein the backwash pump is connectable to the washing water return.

16. The multi-tank dishwasher according to claim 1, wherein the sewage pump is connectable to the sewage line.

17. A multi-tank dishwasher with at least one washing zone for acting upon a wash batch with washing water in a washing chamber, the at least one washing zone comprising:

at least one washing water storage tank;

at least one filter housing;

at least one fine filter introduced into the at least one filter housing, the at least one fine filter subdividing at least one inner space of the at least one filter housing into at least one dirty water space and at least one clean water space, the at least one dirty water space being capable of being acted upon with washing water from the washing chamber via at least one washing water inflow, the at least one fine filter having at least one filter wall, in such a way that, in a normal operation of the multi-tank dishwasher, washing water flows from the at least one dirty water space through the at least one filter wall into the at least one clean water space, and the at least one clean water space being connected to the at least one washing water storage tank via at least one outflow device; and at least one backwash device comprising:

at least one washing water return connected to the at least one clean water space;

at least one backwash pump;

at least one sewage line connected to the at least one dirty water space; and at least one sewage pump, wherein, in a backwash operation, a washing water flow between the at least one clean water space and the at least one dirty water space through the at least one filter wall is reversible by means of the backwash device, wherein the at least one washing water return is connected to the at least one outflow device, and wherein a flow direction of the washing water through the at least one outflow device defines an outflow direction in normal operation, the at least one washing water return being connected to the at least one outflow device in such a way that, in backwash operation, the at least one outflow device can be acted upon by washing water with a velocity component opposite to the outflow direction by means of the at least one washing water return.

18. A multi-tank dishwasher with at least one washing zone for acting upon a wash batch with washing water in a washing chamber, the at least one washing zone comprising:

at least one washing water storage tank;

at least one fitter housing;

at least one fine filter introduced into the at least one filter housing, the at least one fine filter subdividing at least one inner space of the at least one filter housing into at least one dirty water space and at least one clean water space, the at least one dirty water space being capable of being acted upon with washing water from the washing chamber via at least one washing water inflow, the at least one fine filter having at least one filter wall such that, in a normal operation of the multi-tank dishwasher, washing water flows from the at least one dirty water space through the at least one filter wall into the at least one clean water space;

at least one backwash device comprising at least one backwash pump, at least one sewage pump, at least one washing water return, and at least one sewage line, the at least one washing water return being configured to connect the at least one washing water storage tank to the at least one clean water space, the at least one sewage line being connectable to the at least one dirty water space; and at least one outflow device configured to connect the at least one clean water space to the at least one washing water storage tank;

wherein, in a backwash operation, a washing water flow between the at least one clean water space and the at least one dirty water space through the at least one filter wall is reversible via the backwash device.

* * * * *